United States Patent [19]

Dittmann et al.

[11] 4,215,911

[45] Aug. 5, 1980

[54] BATTERY TERMINAL FOR TELEPHONE STORAGE BATTERIES

[75] Inventors: Larry E. Dittmann, Harrisburg; Van K. Webster, Camp Hill, both of Pa.

[73] Assignee: AMP Incorporated, Harrisburg, Pa.

[21] Appl. No.: 43,393

[22] Filed: May 25, 1979

[51] Int. Cl.[2] ..... H01R 7/06

[52] U.S. Cl. ..... 339/240; 339/273 F

[58] Field of Search ..... 339/240, 273 R, 273 F

[56] References Cited

U.S. PATENT DOCUMENTS

| | | | |
|---|---|---|---|
| 1,667,485 | 4/1928 | MacDonald | 339/273 |
| 1,877,142 | 9/1932 | Merritt | 339/240 |
| 2,107,835 | 2/1938 | Pierce | 339/273 |
| 2,541,617 | 2/1951 | Scott | 339/240 |

*Primary Examiner*—John McQuade

*Attorney, Agent, or Firm*—Allan B. Osborne

[57] ABSTRACT

The present invention relates to a battery terminal for use on low voltage, high current storage batteries of the type used by telephone companies. More particularly the terminal comprises an elongated split cylinder which slides over the battery post, a locking subassembly for securing the cylinder to the post and a wire barrel adapted to be crimped onto a conductor.

3 Claims, 11 Drawing Figures

Fig. 2
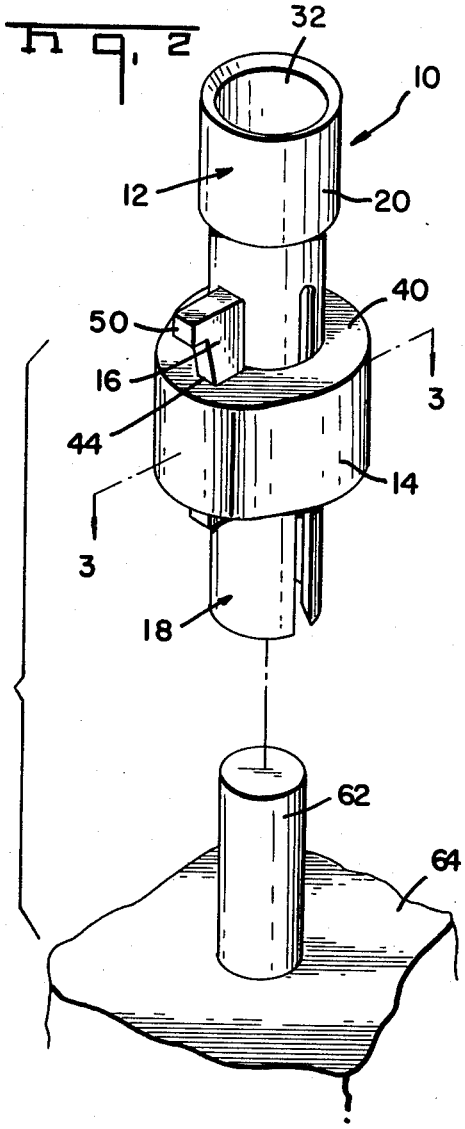
Fig. 4
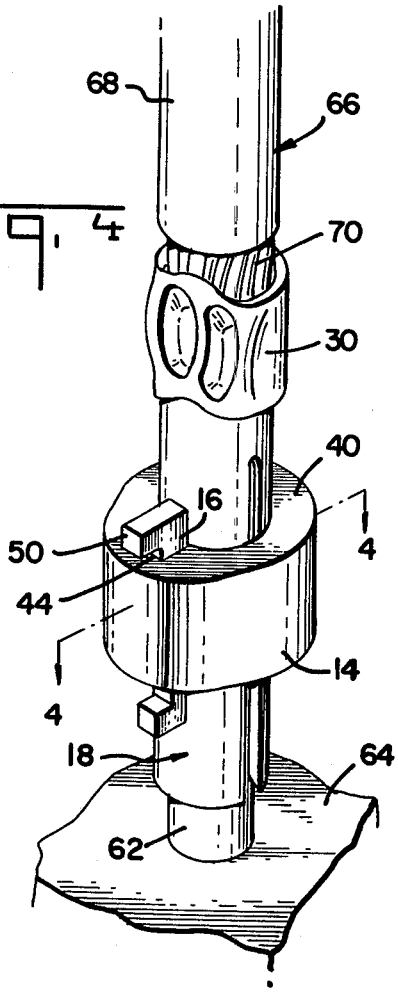
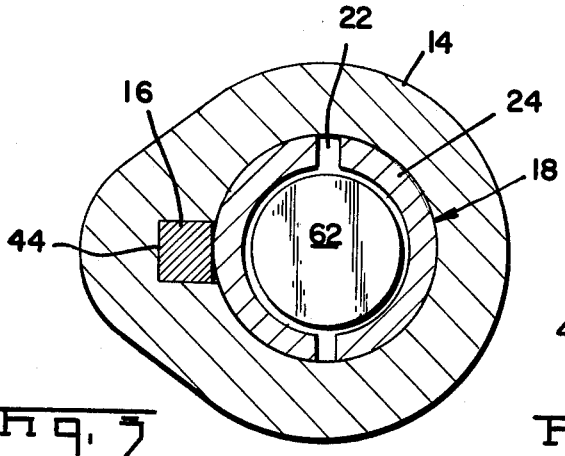
Fig. 3
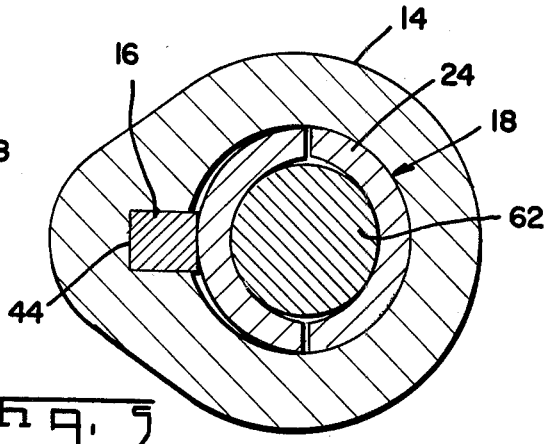
Fig. 5

BATTERY TERMINAL FOR TELEPHONE STORAGE BATTERIES

BACKGROUND OF THE INVENTION

1. Field of the Invention

This invention is related to battery terminals for batteries having cylindrical posts.

2. Prior Art

Telephone companies have been using low voltage, high current storage batteries for many years. Hereto before and currently the batteries have posts which are square in cross-section. Flat conductors are attached by bolts extending through the posts. At least one company is now experimenting with batteries having cylindrical posts to avoid corrosion and other problems associated with the bolts and square posts.

SUMMARY OF THE INVENTION

The present invention provides a battery terminal for cylindrical posts. The terminal has on one end a cylindrical section which has a plurality of slots to divide the section into fingers. A locking member having a locking wedge associated therewith compresses the fingers about the post for electrical contact and mechanical retention. The other end of the terminal has a wire barrel which is adapted for crimping about a conventional round conductor.

BRIEF DESCRIPTION OF THE DRAWINGS

FIG. 2 is a perspective drawing showing the assembled terminal of the present invention along with a terminal-receiving post;

FIG. 3 is a cross-sectional view taken along lines 3—3 of FIG. 2;

FIG. 4 also a perspective drawing, shows the terminal with a wire crimped to it and mounted on the post;

FIG. 5 is a cross-sectional view taken along lines 5—5 of FIG. 4;

DESCRIPTION OF THE INVENTION

Figure 1A:
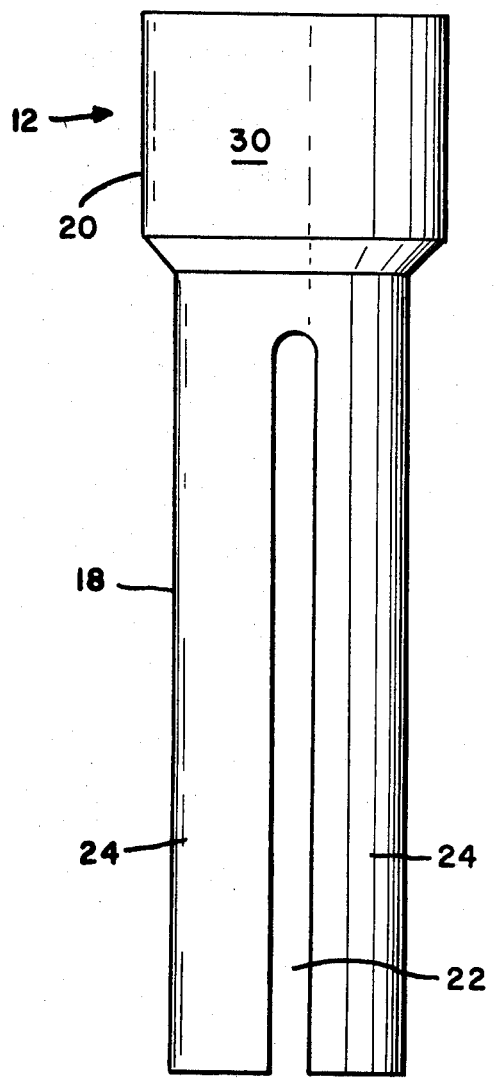
FIGS. 1-a through 1-e are drawings of the several components of the terminal of the present invention.
Figure 1B:
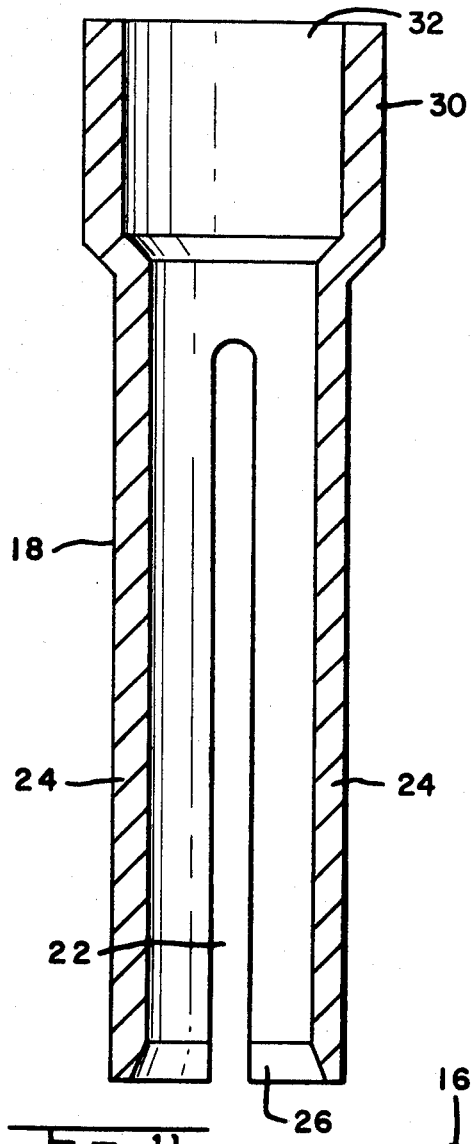
Figure 1C:
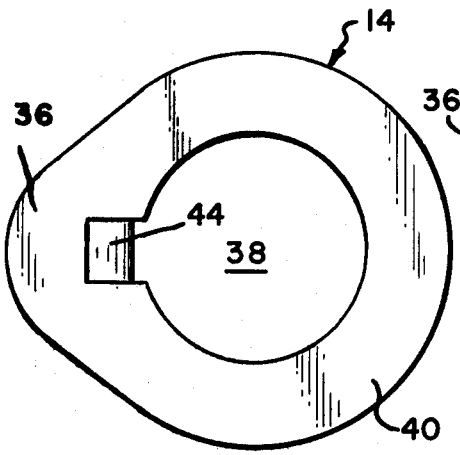
Figure 1D:
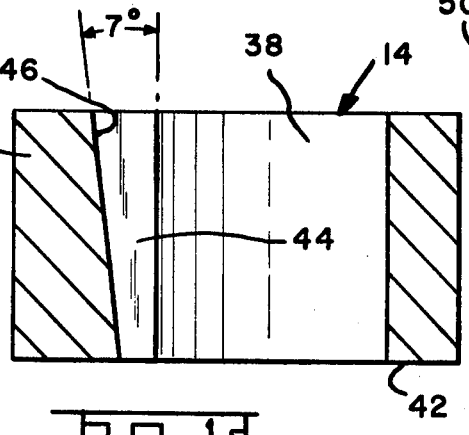
Figure 1E:
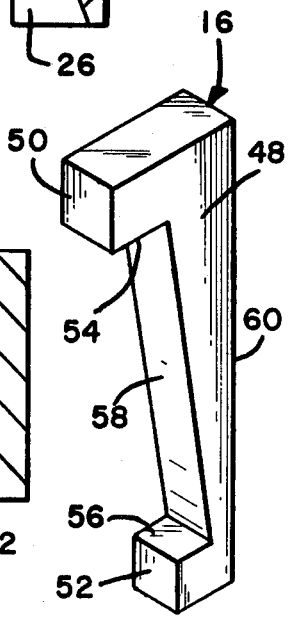

FIG. 2 shows terminal 10 of the present invention assembled and ready for use. Its three components are socket 12, locking member 14 and wedge 16.

With reference to FIGS. 1-a through 1-e, each component will now be described.

FIG. 1-a is a side elevation of socket 12 and FIG. 1-b is a cross-section thereof. The socket has a hollow, cylindrical section 18 at its front or leading end and a wire receiving section 20 at its back or trailing end. More particularly the cylinder has a plurality of longitudinal slots 22 (only one of which is shown) which separates the cylinder into a plurality of resilient fingers 24. At the cylinder's leading end, each finger is beveled on its inner surface as indicated by reference numeral 26 in FIG. 1-b.

Wire-receiving section 20 includes a means for attaching a wire to the socket. Shown here is a barrel 30 defining a cavity 32 which opens rearwardly. Other wire receiving means can be utilized in lieu of a barrel.

Socket 12 is preferably made from copper and is tin plated. The shape and construction thereof lends itself to manufacture by impact-extrusion.

Locking member 14 is shown in FIGS. 1-c and 1-d; the former being a top plane view and the latter being a side elevational cross-section.

The member's circumference is non-circular, one side being bulged out as indicated by reference numeral 36. An opening 38 extends through the member from the upper surface 40 through the lower surface 42. A slot 44 is cut into the wall on one side of the opening in the bulged-out area 36. The slot extends through the member in parallel relation to the opening.

The floor 46 of slot 44 is beveled inwardly; i.e., towards opening 38, from the upper surface 40 to lower surface 42. As shown in FIG. 1-d, the angle of the bevel is seven degrees relative to the vertical.

The increase in thickness in bulged-out area 36 accommodates slot 44, without sacrificing the member's strength, particularly adjacent its upper surface 40 where the slot is deepest.

Member 14 is preferably made from stainless steel.

Wedge 16 is shown in FIG. 1-e. It has an elongated wedge section 48 bounded by lug 50 on its upper end and lug 52 on its lower end. As seen in FIG. 2, the wedge is positioned in the locking member so that the lugs point outwardly; i.e., away from socket 12. The lugs provide downwardly and upwardly facing shoulders 54 and 56 respectively.

The outwardly facing side 58 of section 48 is beveled inwardly from top to bottom. The angle relative to the vertical is seven degrees. The opposite side 60 is straight; i.e., parallel to the vertical.

Wedge 16 is preferably made from stainless steel.

Figure 6:
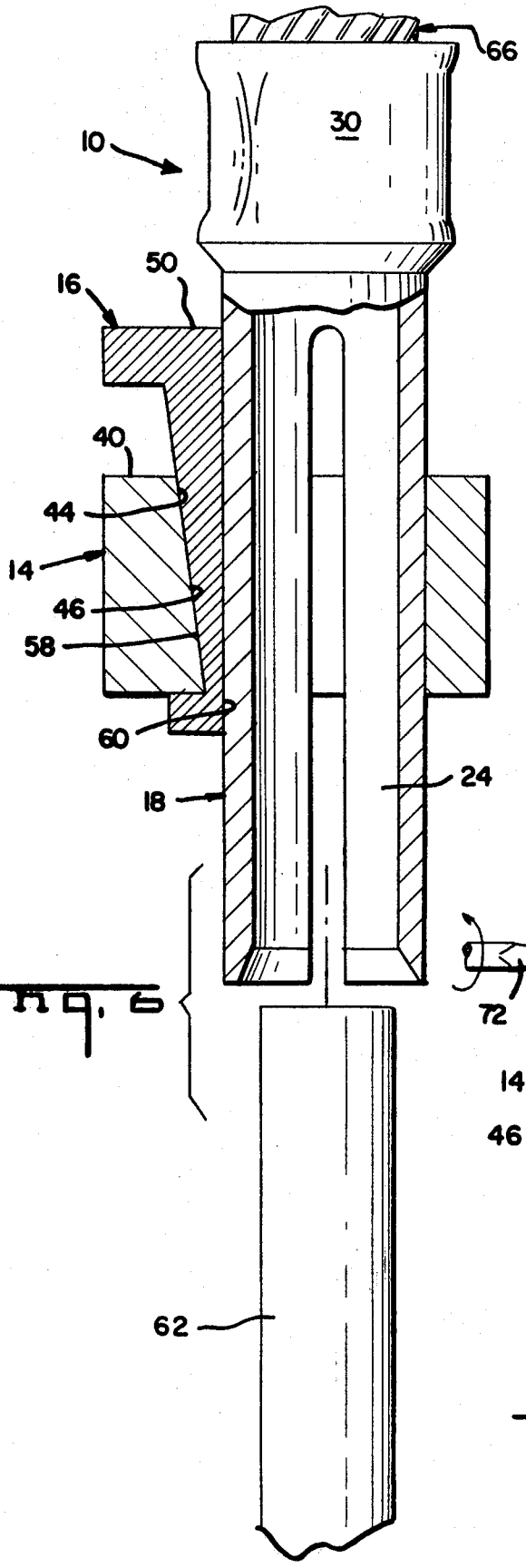
FIG. 6 is an elevational view with the terminal cross-sectioned to show the relation between the several components.

FIG. 2 shows an assembled terminal 10 perspectively with FIG. 6 being a side elevation, cross-sectional view; both views including battery post 62. FIG. 2 also shows fragmentarily battery 64. With reference to both Figures, it can be seen that wedge 16 is slidably positioned in slot 44 of locking member 14. Note that the beveled surfaces; i.e., floor 46 of the slot, and the wedge's outer side 58, bear against each other in a manner such that the wedge's straight side 60 is always parallel to cylindrical section 18 on the socket. With the wedge orientated, thusly, its upper lug 50 is adjacent the member's upper surface 40.

The subassembly comprising the wedge and locking member is slid onto the cylindrical section 18 of socket 12. Preferably lug 50 and the member's upper surface 40 face towards barrel 30. The subassembly is easily retained on the socket by moving the wedge down slot 44.

FIG. 3 is a view looking down on the terminal so as to show the relation between the several components.

Figure 7:
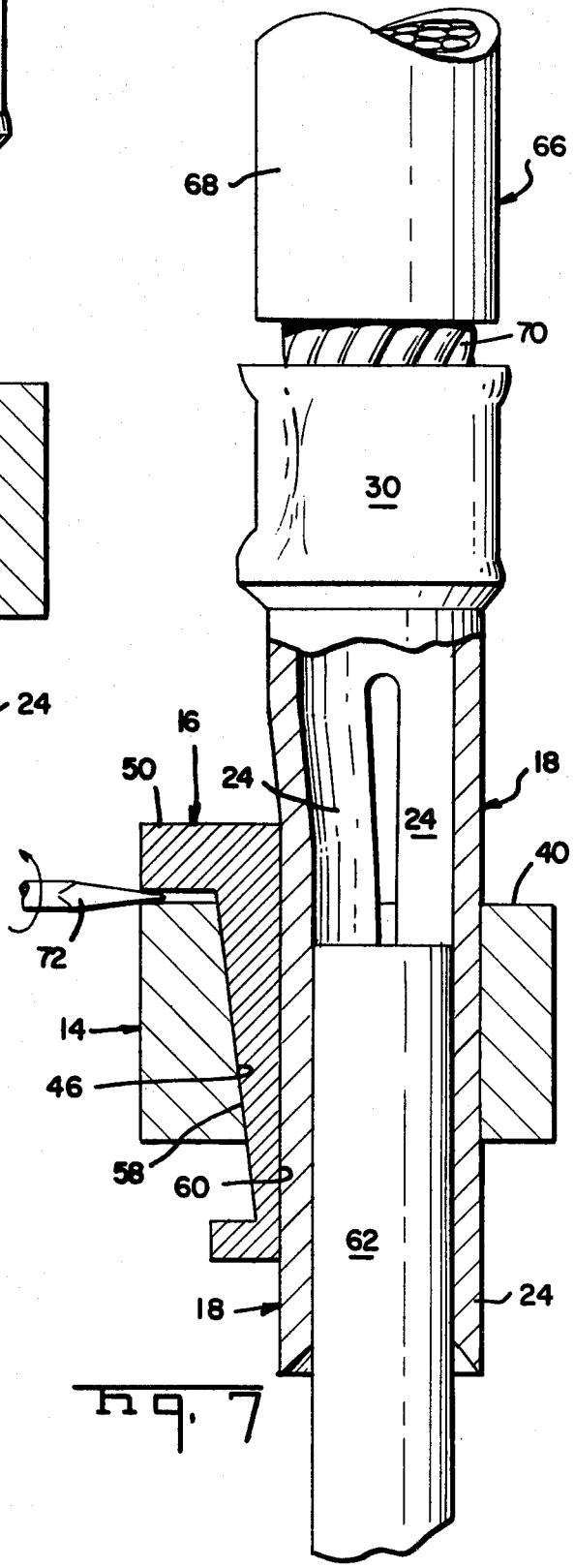
FIG. 7 is a view similar to FIG. 6 but with the terminal mounted in the post, the view further illustrates one method for releasing the terminal from the post.

An insulated wire 66 is shown in FIGS. 4, 6, and 7 attached to terminal 10. In this embodiment a length of insulation 68 has been removed to expose end 70 which is inserted into barrel 30. The barrel is crimped down around the end to effect the termination. Obviously, other means can be used to connect the wire; e.g., open barrel ferrule and soldering.

FIGS. 4, 5, and 7 are views illustrating the terminal removably connected to post 62. The method of connecting the two is straight forward: The wedge is moved up so as to allow the member to be freely moved. By sliding member 14 towards barrel 30, fingers 24 can expand outwardly as the split cylinder is pushed on over post 62. Thereafter, with the wedge still loosely positioned in the slot, the member is pushed down towards the cylinder's free end. Positive electrical contact and mechanical retension is obtained by pushing the wedge down along the beveled surface of slot 44 reducing the effective diameter of opening 38 and thereby compressing the fingers against post 62. A hammer may be used to drive the wedge down.

Terminal 10 is easily removed from the post by inserting tip 72 of a screwdriver (FIG. 7) between the member's upper surface 40 and the wedge's lug 50. The tip is rotated as indicated by the arrow in FIG. 7 or by prying up. In either case wedge 16 travels up the slot to increase the diameter of opening 38. The member is then moved freely up the split cylinder to relax the pressure against the fingers and post.

It is to be understood that the forms of the invention shown and described herein are but preferred embodiments thereof and that various changes and modifications can be made therein without departing from the spirit or scope of the invention.

What is claimed is:

1. A battery terminal for use with cylindrical battery posts, which comprises:

a. a socket having wire receiving means at one end and a hollow cylindrical section at the other end for sliding onto a cylindrical battery post, said cylindrical section being longitudinally slotted to provide two or more resilient fingers;

b. a member having an opening therethrough with a longitudinal slot cut into the wall along one side thereof, the floor of the slot being beveled from one side of the member to the other, said member slidably positioned on the cylindrical section; and c. an elongated wedge having one straight side and an opposing beveled side slidably positioned in the slot in the member with the beveled side against the slot's beveled floor so that the wedge's straight side faces the opening and is parallel thereto, said member and wedge cooperating to compress the cylinder's fingers about a cylindrical battery post to provide electrical contact and mechanical retention therewith.

2. The battery terminal of claim 1 wherein the free end of the resilient fingers are beveled on the inside surfaces to provide a tapered lead-in.

3. The battery terminal of claim 1 wherein the wedge includes a laterally projecting lug at each end.

* * * * *